US008628427B2

(12) United States Patent
Koberinski et al.

(10) Patent No.: US 8,628,427 B2
(45) Date of Patent: Jan. 14, 2014

(54) VARIABLE CONTOUR FLOOR SYSTEM

(75) Inventors: Arthur Koberinski, Kincardine (CA); Kailash C. Vasudeva, Waterloo (CA)

(73) Assignee: 1066626 Ontario Ltd., Waterloo (CA)

( * ) Notice: Subject to any disclaimer, the term of this patent is extended or adjusted under 35 U.S.C. 154(b) by 414 days.

(21) Appl. No.: 13/020,905

(22) Filed: Feb. 4, 2011

(65) Prior Publication Data

US 2011/0192096 A1 Aug. 11, 2011

Related U.S. Application Data

(60) Provisional application No. 61/301,727, filed on Feb. 5, 2010.

(51) Int. Cl.
*E01C 13/08* (2006.01)
*A63C 19/10* (2006.01)

(52) U.S. Cl.
USPC ..... 472/92; 473/157

(58) Field of Classification Search
USPC ..... 472/88–92; 473/157, 158, 159, 160, 473/161, 162, 163, 164
See application file for complete search history.

(56) References Cited

U.S. PATENT DOCUMENTS

| | | | | | |
|---|---|---|---|---|---|
| 3,522,947 | A * | 8/1970 | Anderson et al. | ..... | 473/158 |
| 3,595,581 | A * | 7/1971 | Anderson et al. | ..... | 473/161 |
| 4,202,547 | A * | 5/1980 | Mueller | ..... | 473/161 |
| 4,790,538 | A * | 12/1988 | Gettelfinger | ..... | 473/161 |
| 5,031,916 | A * | 7/1991 | Boswell | ..... | 473/158 |
| 6,164,173 | A * | 12/2000 | Crudgington et al. | ..... | 82/1.11 |
| 6,766,684 | B2 * | 7/2004 | Bertz et al. | ..... | 73/116.01 |

* cited by examiner

*Primary Examiner* — Kien Nguyen
(74) *Attorney, Agent, or Firm* — R. Craig Armstrong

(57) ABSTRACT

A somewhat flexible floor assembly is supported by a matrix of spaced-apart vertically-adjustable devices, such as electrically-operated jacks operated by servo motors. The devices are centrally individually controlled whereby height of the devices may be individually varied so that the floor surface may have its contour varied as desired. Somewhat flexible metal rods are supported by the jacks, and they in turn support joist assemblies which support a subfloor and flooring surface. The vertically-adjustable devices may be controlled by a computer, which may access data corresponding to a number of selectable pre-configured contours, such that selection of one of the pre-configured contours causes the height of the devices to vary so as to move the floor surface to a configuration corresponding to the selected pre-configured contour. The pre-configured contour may be, for example, a simulation of a real-life golf green.

16 Claims, 8 Drawing Sheets

VARIABLE CONTOUR FLOOR SYSTEM

CROSS-REFERENCE TO RELATED APPLICATIONS

This is a formal application based on and claiming the benefit of U.S. Provisional Patent Application No. 61/301,727, filed Feb. 5, 2010, which is hereby incorporated by reference.

FIELD OF THE DISCLOSURE

This disclosure relates to a floor system which has means for varying the contour of the floor vertically, to provide varying undulations as desired. The disclosure is particularly useful and particularly intended for use as an artificial golf putting green, so that the undulations in the floor can mimic the undulations found in typical golf greens. However, the disclosure has many other potential applications, such as any situation where it is or may be desirable to be able to produce a surface with undulations, and to be able to readily vary or reconfigure those undulations.

More particularly, the disclosure involves a floor surface, supported by a number of controllable jacks or like devices at a number of locations. Selectively varying the height of the jacks or other devices produces undulations of the floor surface as desired.

BACKGROUND OF THE DISCLOSURE

The prior art includes various systems for varying the contour of floors, such as wedges (inclined planes) operable from a side of the floor to raise or lower blocks which support the floor surface. However, to the best of the inventors' present knowledge, there are no prior art systems which employ remotely-controlled jacks or like devices in any configuration as effectively as in the present disclosure.

SUMMARY OF THE DISCLOSURE

In view of the preceding, it is an aspect of the disclosure to provide a floor system which has variable contour floor.

In the disclosure, the floor system has a somewhat flexible floor assembly, supported by a matrix of spaced-apart vertically-adjustable devices, such as electrically-operated jacks for example. The devices are centrally individually controlled whereby height of the devices may be individually varied so that the floor surface may have its contour varied as desired.

Preferably but not necessarily, the disclosure further includes the vertically-adjustable devices being controlled by a computer. Preferably but not necessarily, the computer accesses data corresponding to a number of selectable pre-configured contours, such that selection of one of the pre-configured contours causes the height of the devices to vary so as to move the floor surface to a configuration corresponding to the selected pre-configured contour. The pre-configured contour may be, for example, a simulation of an existing "real" golf green.

Throughout this description and in the claims, "golfing surface" normally means a golf green, but may also include golf tee areas, golf fairways, or other golf surfaces, including mini-golf surfaces.

Further aspects of the disclosure will be described or will become apparent in the course of the following detailed description.

BRIEF DESCRIPTION OF THE DRAWINGS

In order that the disclosure may be more clearly understood, exemplary embodiments thereof will now be described in detail, as examples only, with reference to the accompanying drawings, in which.

DETAILED DESCRIPTION OF THE PREFERRED EMBODIMENT

FIGS. 1-6 show a preferred embodiment of the floor system.

Figure 1:
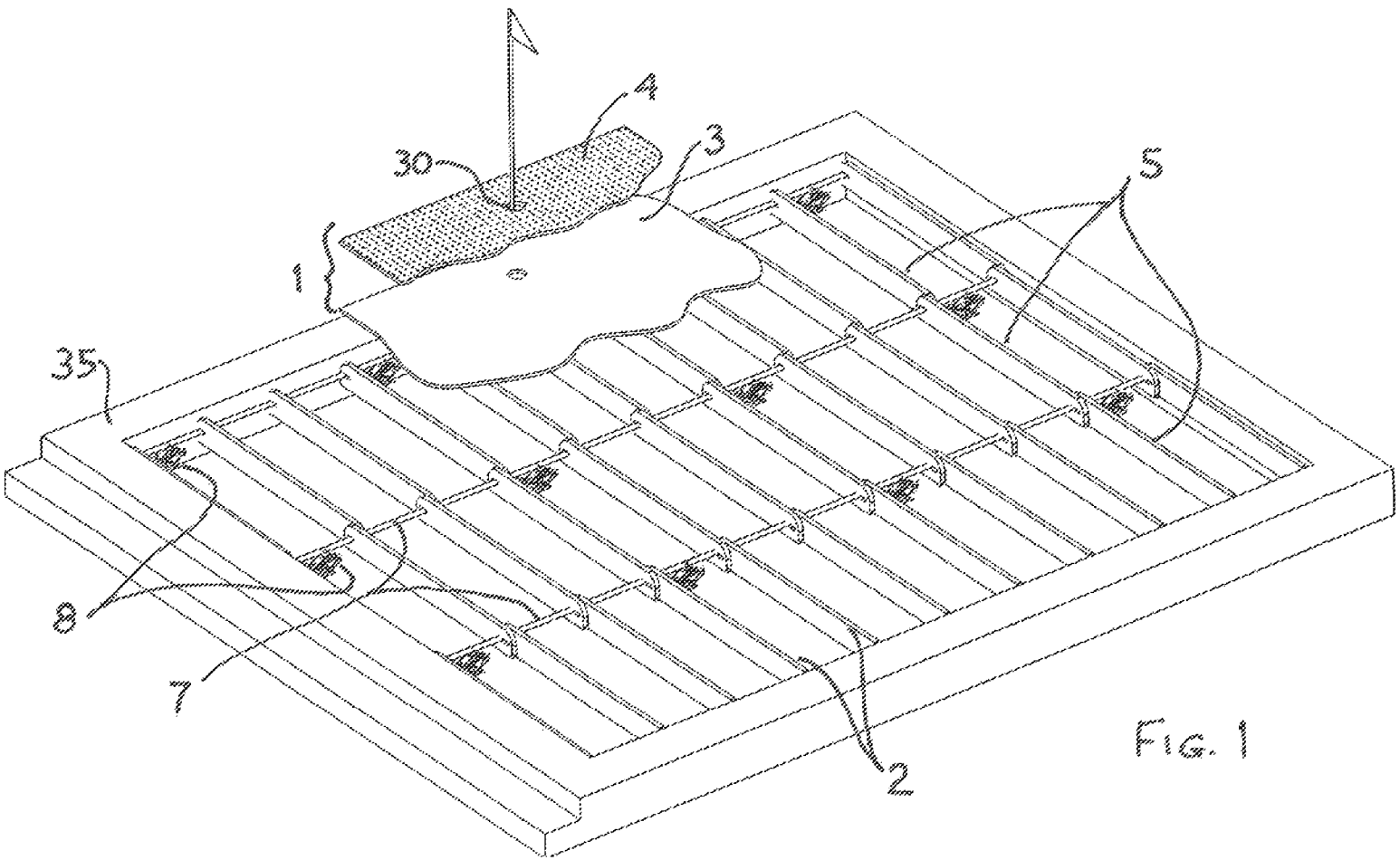
FIG. 1 is an exploded perspective view of a preferred embodiment of the disclosure, configured as an artificial golf green.
Figure 2:
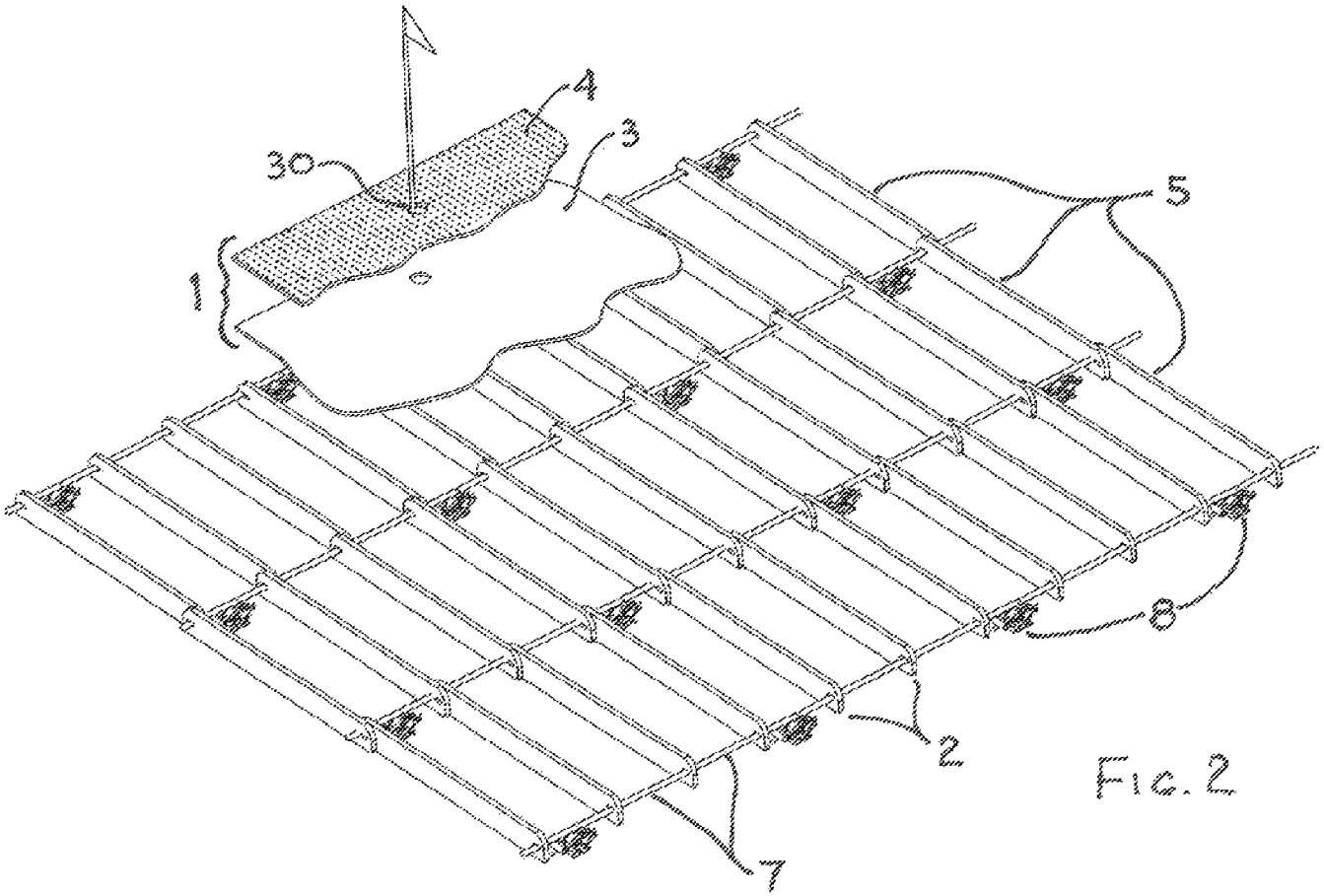
FIG. 2 is a similar view to FIG. 1, but without the surrounding frame.

As seen most clearly in FIGS. 1 and 2, the floor assembly has a surface assembly 1, supported by suitably spaced-apart joist assemblies 2. The surface assembly consists of a subfloor 3 of one or more or sheathing layers (plywood for example), and a flooring surface 4 above the subfloor. Where the disclosure is being used to simulate a golf green, the flooring surface 4 is a layer of artificial turf. Although there are many manufacturers and suppliers of artificial turf (and carpeting in general), one particular example is the artificial turf sold by Putter's Edge Custom Putting Greens, 27 Greenloch Drive, Pataskala, Ohio 43062, U.S.A., under its Putter's Edge trademark.

Each joist assembly 2 has at least two joist sections 5, there being three such sections in the illustrated embodiment. Theoretically, there could be an unlimited number of such joist sections, depending on how large a surface is desired.

The adjacent joist sections 5 are offset to overlap each other, and are provided with a slotted aperture 6 adjacent each end. The joist assemblies 2 run parallel to each other, and may be spaced apart by any distance suitable to meet the conflicting requirements of being sufficiently close to each other to adequately support the weight of the floor and people on the floor, and sufficiently far apart to provide a desired degree of flexibility in order for the contour of the floor to be adjusted.

Generally rigid but slightly flexible metal rods 7, such as 1-inch diameter steel rods, extend longitudinally through the slotted apertures 6 of the joist assemblies 2, both where adjacent joist sections 5 overlap, and at outer ends of the joist assemblies. The rods are supported on vertically-adjustable devices such as jacks 8, as described in greater details later. In each case, a single rod could extend the length of the floor assembly, or for larger installations, the total length could be made up from several shorter rods. At each location where adjacent joist sections overlap, the rod acts as a pivot axis, such that the joist sections can rotate about that axis. Further-more, by virtue of the slotted apertures 6, the joist sections can float longitudinally on the rods, in addition to being able to slide laterally, i.e. in the direction of the length of the rods. This allows the floor assembly to flex.

Figure 6:
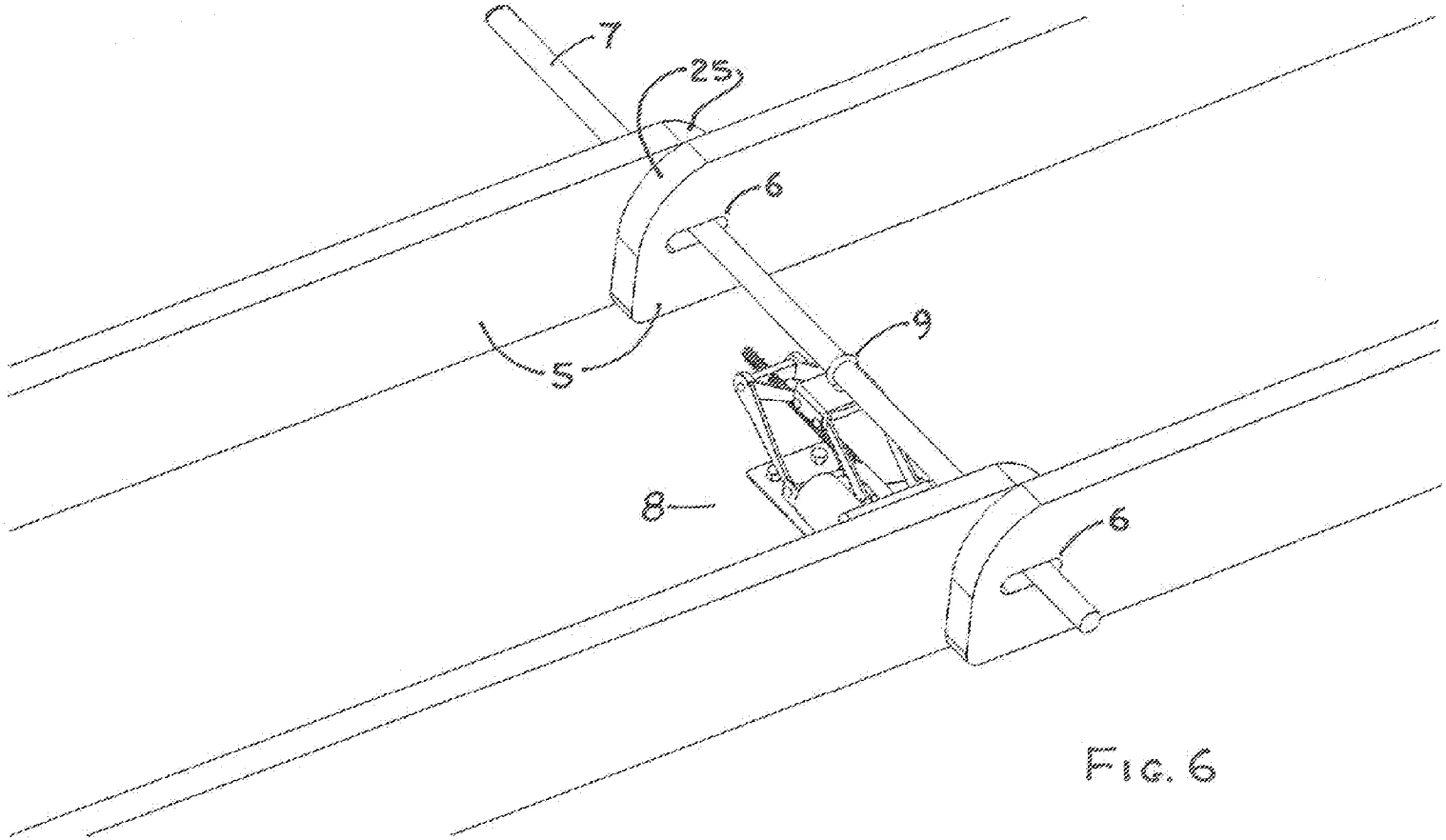
FIG. 6 is a perspective view showing one of the metal rods passing through the apertures in overlapping joist sections.

Looking at FIG. 6, consider what happens when the jack 8 is raised relative to all adjacent jacks. As the jack rises, the rod 7 bends to allow that movement. Adjacent joist assemblies will also rise somewhat, producing a smooth contour to the next jack along the rod, which is the next point at which the rod is secured. As for contouring in the other direction, i.e. along the joist assemblies, the two joist sections 5 will pivot slightly downwardly away from each other, about the rod 7, and will displace somewhat by virtue of the slotted apertures 6. The upper ends of each joist section 5 have chamfered or radiused portions 25 to allow this pivoting and displacement. The floor assembly is in this respect a "floating" floor.

The slotted apertures 6 are thus important. In vertical dimension, they need only accommodate the diameter of the rods 7. However, in horizontal dimension, it is important that the apertures be sufficiently long to allow the joist sections to displace as the contour of the floor system is varied. Otherwise, it can be appreciated that raising one area of the floor system would result in strong tensile forces in the subfloor 3, and lowering an area would result in strong compressive forces; the jacks 8 would be working against those forces. However, with the slotted apertures, the joist sections 5 are in effect floating on the rods, in both horizontal directions, i.e. laterally and longitudinally. Thus although the subfloor and floor assembly is secured to the joists, the joist themselves "float" to allow the necessary amount of flexing.

In the preferred embodiment, the joist sections are lengths of 2×8 lumber, each approximately 6 feet long and spaced 2 feet apart, but obviously different materials could be used, and different dimensions could be employed, as determined by routine engineering and experimentation. Spacing of 16 inches or 19.2 inches could also conveniently be used, for example, to simply accommodate 8-foot sheathing sheets. The metal rod 7 is a 1-inch diameter steel rod, but again a different material and/or different diameter could be selected, as long as the rod is sufficiently strong to support the joist sections and thus the overall floor assembly, yet sufficiently flexible to allow the contour of the floor to be varied.

The subfloor, comprising one or more sheathing layers 3, is secured to the joist sections by screws or nails or other suitable means. For simplicity of illustration, only one layer is shown in FIG. 1. However, two layers (⅝ inch tongue and groove plywood for example, combined with ¼ inch mahogany flooring underlay) may be preferable to one thicker layer (¾ inch plywood for example), with one layer running in one direction, and the other layer at ninety degrees to the first layer. Alternative flooring/sheathing materials may be used as desired, whether for cost reasons or to provide greater or lesser strength and flexibility. Liner low density polyethylene (LLDPE) sheeting, as just one example, may be suitable.

For the smoothest contours, it is preferable that the seams between adjacent sheathing layers 3 do not align with the metal rods 7.

The artificial turf layer 4 preferably but not necessarily is glued to the subfloor 3. For golf green simulations, one or more conventional golf cups 30 may be installed in the floor assembly, as desired. If desired, the cups may have an open bottom, fitted with ball collection tubing leading to a central collection point. This provides the possibility of manual or automatic metering, such that users of the system could be charged a fee based on the number of putts made.

As can be readily appreciated from FIG. 2, essentially the whole floor system is supported by the rods 7, on the jacks 8. There is no connection to the frame 35. Thus if the height of the rods at various locations is varied, then instead of a flat flooring surface, the contour of the flooring surface can be varied. The slight flexibility of the rods, and the slight flexibility of the flooring surface itself is sufficient to permit this contouring. Obviously the contouring cannot be too dramatic, without the floor being flexible to an impractical degree and/or having inadequate support for walking on, but there is sufficient flexibility to provide an excellent imitation of a real golf green, for example, providing putts with fairly dramatic "breaks" if desired, or of course straight putts as well, if desired.

Figure 3:
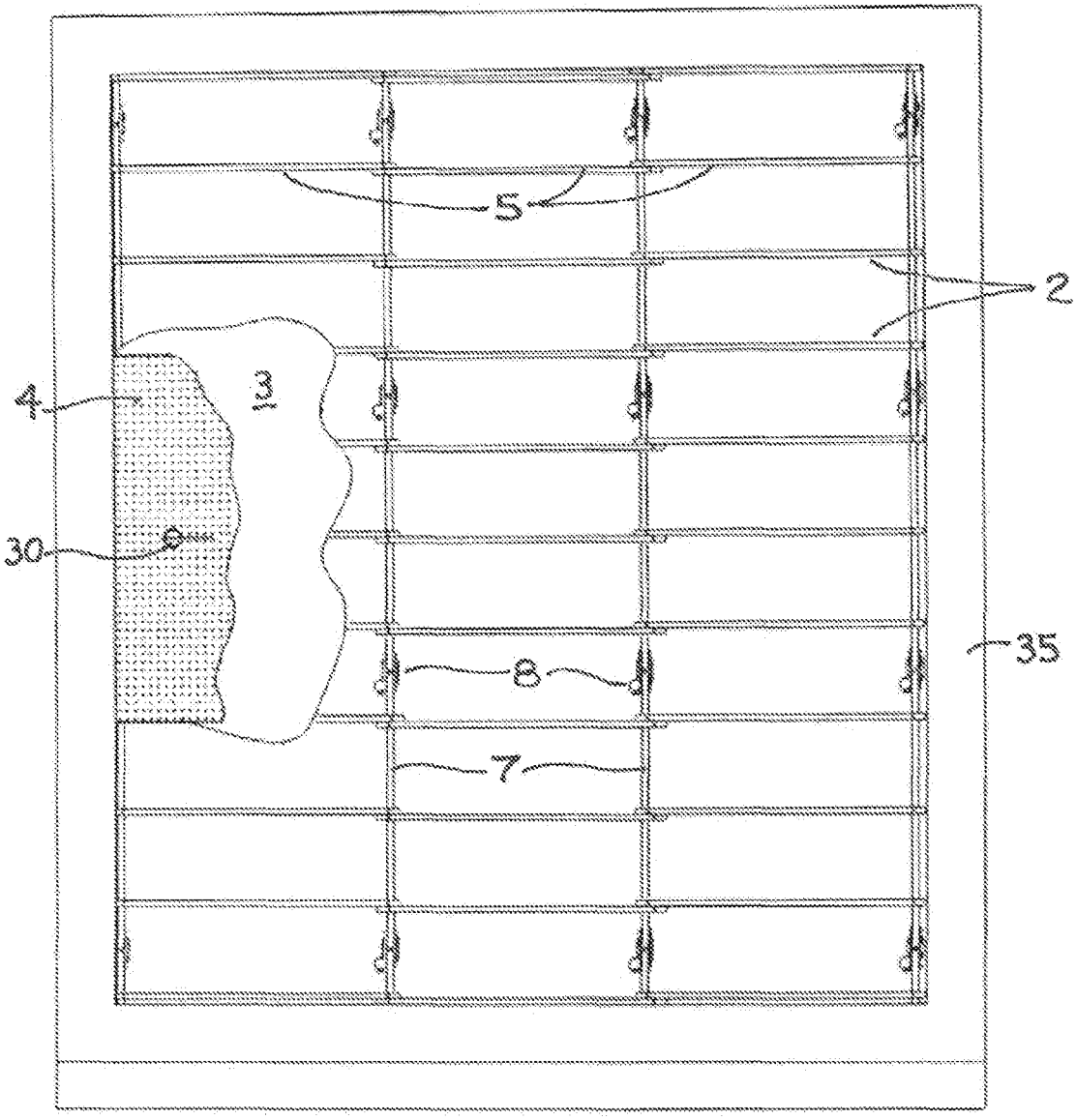
FIG. 3 is a plan view corresponding to FIG. 1.
Figure 4:
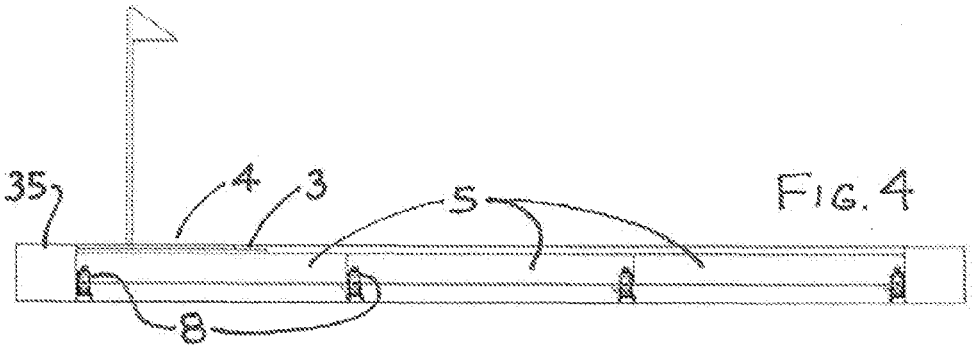
FIG. 4 is a cross-sectional elevation view corresponding to FIG. 3.
Figure 5:
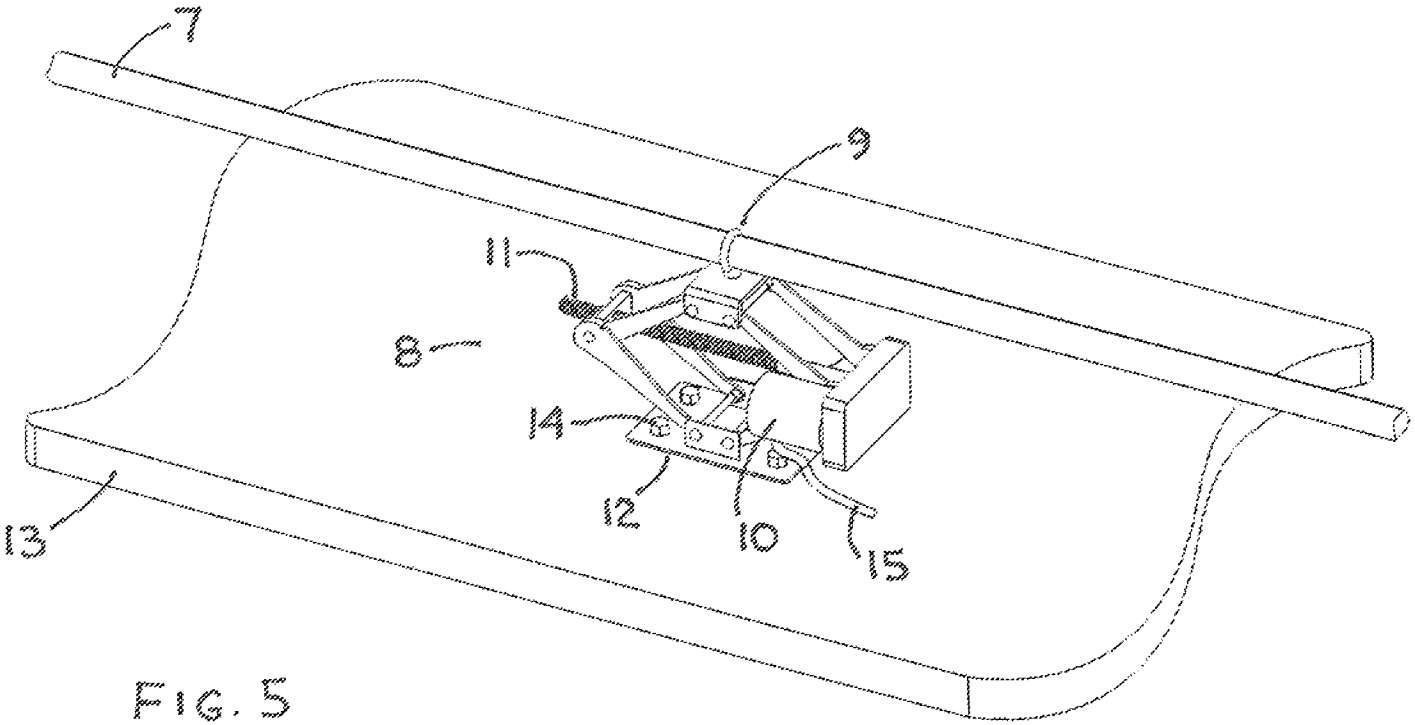
FIG. 5 is a perspective view showing one of the vertically-adjustable devices, a jack, supporting one of the metal rods.

The afore-mentioned vertically-adjustable devices such as jacks 8 are positioned at various points under the rods 7. As seen in FIG. 3, the jacks may be spaced along each rod between every third joist assembly 2, for example, though obviously that spacing could be varied as desired, to achieve whatever degree of support and contour variability is deemed desirable for the particular installation.

In the preferred embodiment, each vertically-adjustable device or jack 8 is provided with a eye-bolt 9 or the like at the top thereof, and the rod 7 is routed through the eye-bolt.

The vertically-adjustable device or jack 8 may be, as illustrated in FIGS. 1-6, a conventional scissors jack, driven by a DC motor 10 which drives the screw 11 to raise or lower the jack. The jack base 12 is securely mounted to a base surface 13, for example by bolts 14. The base surface could be a concrete floor, for example, or a poured concrete post, wooden floor, framing element, or any other surface capable of supporting the load of the floor system.

Simple up and down controls for the jacks 8 may be connected to the motors 10 via wires 15, and the jacks may be individually controlled in this manner, for example from a panel where the individual controls are conveniently mounted. Conceivably, this function could be carried out wirelessly as well, if desired.

Preferably, however, the motors 10 are servo motors, and are controlled by a servo controller 20. The servo controller may be integrated with a computer 21, or may be a separate unit controlled by the computer.

Figure 7:
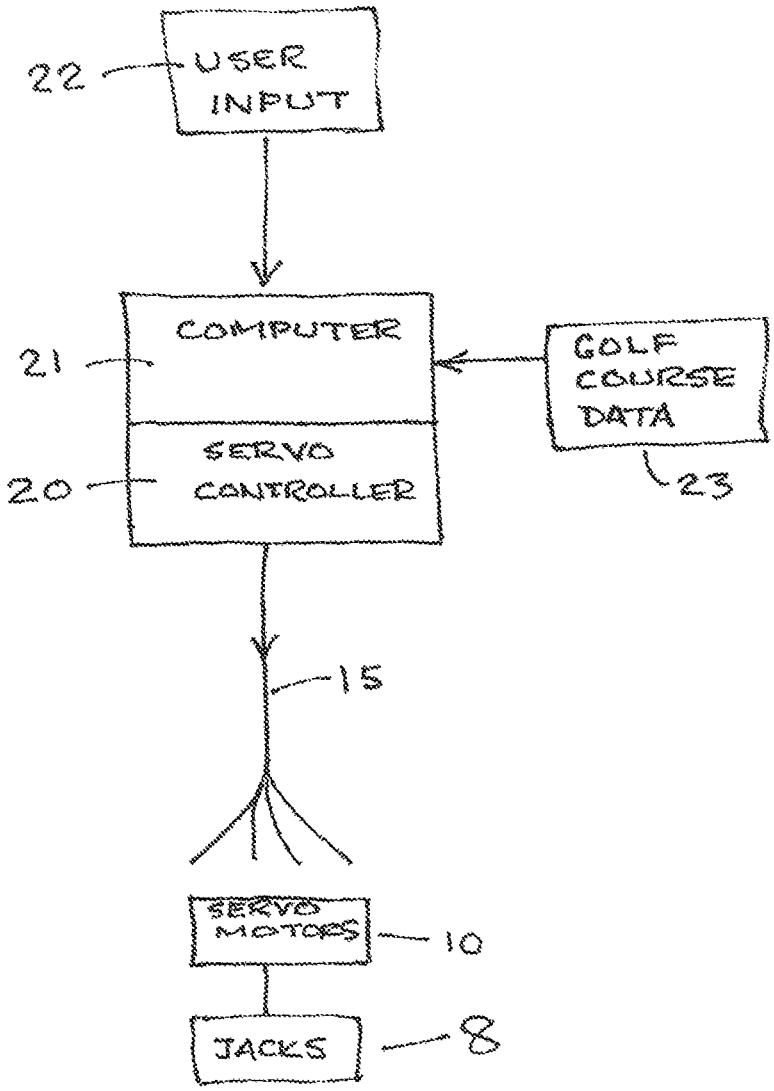
FIG. 7 is a schematic block diagram of controls for the floor system in a preferred embodiment.

FIG. 7 is a schematic block diagram of a preferred control arrangement for such a system. It is a particular advantage of the disclosure, when implemented to simulate a golf green, that it can be readily configured to mimic any particular green or portions thereof, where elevation data for that green has been collected or is available from third parties. The user can thus specify, for example, that he/she wishes to play the $7^{th}$ green at Pebble Beach, using a keyboard, mouse, touch screen or other input device 22 to communicate that wish to the computer 21. The computer is loaded with, or has access to, the relevant elevation data 23, and acts as a servo controller 20 (or sends a signal to a separate servo controller), which controls the various servo motors so that the jacks 8 move relevant portions of the artificial green up or down to match the data.

The specific means by which the raising and lowering is accomplished is not essential to the disclosure as broadly defined. For example, it is conceivable, though likely not practical or cost effective, that hydraulic jacks could be employed, and that a manually operated or computer-controlled hydraulic system could be employed.

Figure 8:
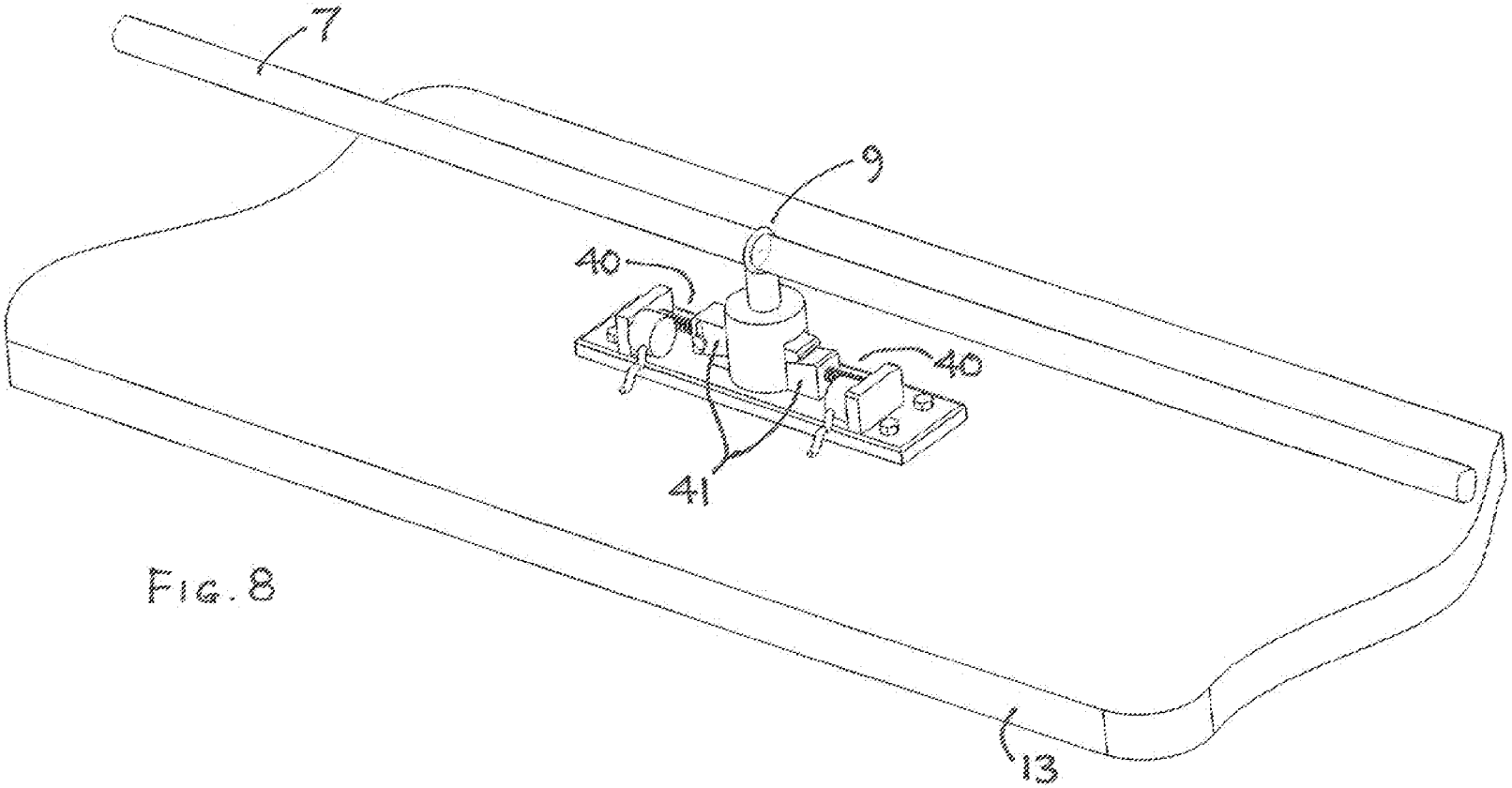
FIG. 8 is a perspective view showing an example of an alternative vertically-adjustable device, supporting one of the metal rods.
Figure 9:
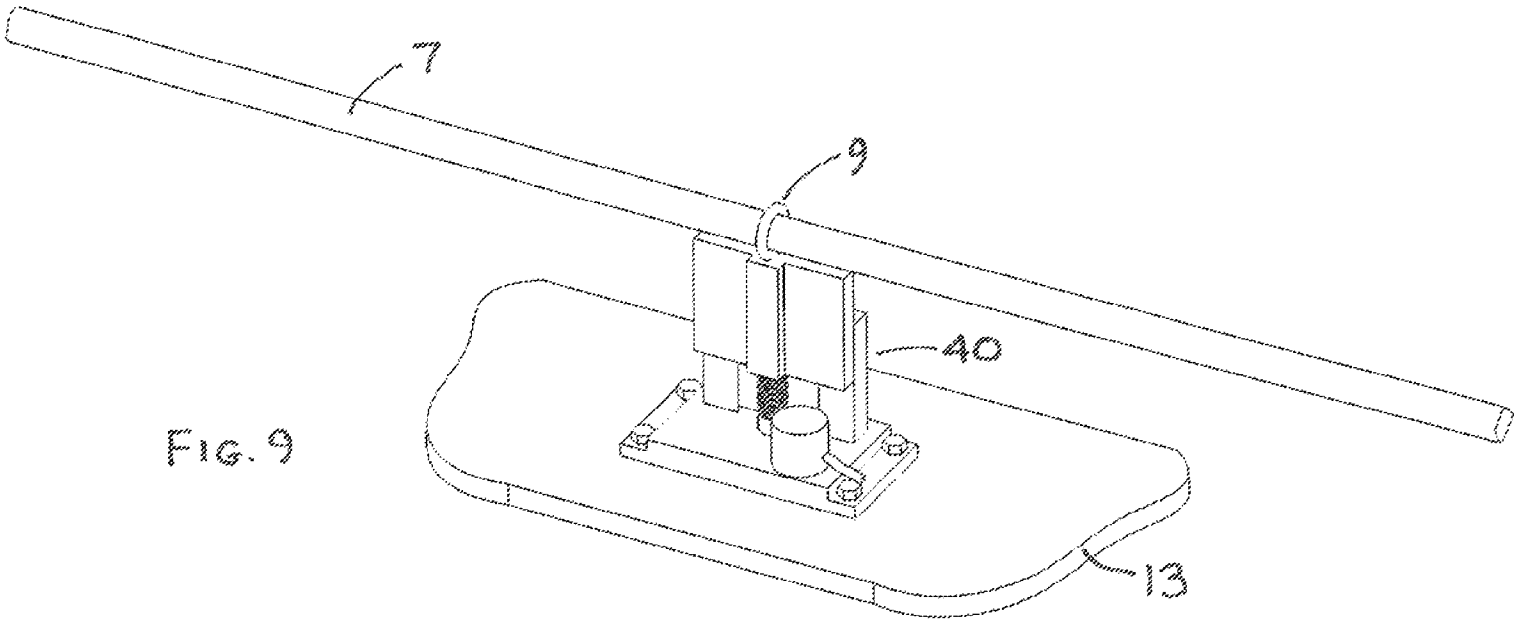
FIG. 9 is a perspective view showing an example of another alternative vertically-adjustable device, supporting one of the metal rods.

Similarly, it is not essential that a scissors-type jack be employed. As just one example, one or two CNC slides 40 could be mounted on the base surface 13, to produce linear movement of wedges (inclined planes) 41 to produce vertical movement. This is illustrated schematically only, in FIG. 8. Routine engineering may be required to improve this embodiment, but FIG. 8 illustrates the principle. Similarly, a vertically-oriented CNC slide 40 could be used as illustrated schematically in FIG. 9.

An installation of the floor system will typically result in the flooring surface being at some height above the surrounding floor or base surface 13. Therefore, it will normally be preferable, though not essential, to provide an elevated platform 35 around the structure, as shown in FIG. 1. The height of the platform would be set to the nominal or average height of the flooring surface, so that there will be only a small height difference, if any, to minimize any tripping hazard. Alternatively, the rods running along outer side edges of the flooring system could be fixed in height, and the other rods could be fixed in height at their ends. The flooring surface 4 could extend from the floor assembly out onto the platform as well, if desired.

The surface of the platform may be covered with artificial turf if desired, and may be extended some distance, to act as a fixed artificial green. In fact, the movable portion of a complete installation may only be a small portion of the total surface covered in artificial turf. It is advantageous, for example, to provide a relatively large area of artificial turf adjacent to the artificial green, as a chipping area. For a chipping area, it may be preferably to use a much rougher turf, to simulate longer grass. One or more steps may be provided up to the platform.

In some installations, the flooring assembly may be recessed into the surrounding floor, or into the ground outdoors, with its upper surface flush with its surroundings. In such cases, for maintenance or repair purposes, it will be necessary to provide an access tunnel along one side of the installation, in case someone needs to have access to one of the jacks, for example. Similarly, in above-ground applications, any platform 35 must be readily removable or provided with access ports, so that someone can crawl underneath the assembly for any necessary maintenance.

Typically but not necessarily, the artificial green will be considerably smaller than the real green, or may have extreme contours which cannot be matched. In that case, the user may be provided with various options, including either scaling down the features of the real green proportionately to fit the artificial green, or maintaining the scale but selecting only a portion of the real green ("back right", for example). If the artificial green is matched to a golf simulator, such as those manufactured and sold by About Golf, for example, then the approach shot to the green may dictate to the computer which portion of the green is to simulated. Of course if the ball is considered to have landed on the front left of the green, and the pin is on the back right of the green, some compromise will have to be made in simulating the putt. For example, the simulator simply may not permit very long putts to be made. How the marriage of the artificial green to a golf simulator is implemented in practice is beyond the scope of the present disclosure, but certainly the disclosure does offer that capability.

The above embodiments and variations are examples only. Additional embodiments and variations will be apparent or become apparent immediately or in the future to those knowledgeable in the field of the disclosure. The disclosure is not limited to the specific embodiments and variations described herein, but rather is defined by the claims which follow.

The invention claimed is:

1. A floor system, comprising a somewhat flexible floor assembly, supported by a matrix of spaced-apart vertically-adjustable devices, the devices being centrally individually controlled whereby height of the devices may be individually varied so that the floor surface may have its contour varied as desired; wherein said floor assembly comprises:

a surface assembly;

a plurality of generally parallel spaced-apart joist assemblies supporting said surface assembly, said joist assemblies comprising at least one joist section; and a plurality of spaced-apart metal rods running generally at ninety degrees to said joist assemblies, through apertures near opposite ends of said joist sections;

said vertically-adjustable devices acting on said rods at various points to vary the height of said rods and thereby vary the contour of said floor surface.

2. A floor system as in claim 1, wherein each said joist assembly comprises at least two joist sections, adjacent ones of said joist sections overlapping each other such that said apertures align with each other for said rods to pass through, said apertures being elongated such that said joist sections may displace in their longitudinal directions.

3. A floor system as in claim 2, wherein said central individual control of said vertically-adjustable devices is controlled by a computer, and wherein the computer accesses data corresponding to a number of selectable pre-configured contours, such that selection of one of the pre-configured contours causes the height of the devices to vary so as to move the floor surface to a configuration corresponding to the selected pre-configured contour.

4. A floor system as in claim 3, wherein said floor surface is overlaid by an artificial turf, thereby mimicking a golfing surface, and wherein said data accessed by said computer is elevation data of various real golf greens.

5. A floor system as in claim 2, wherein said floor surface is overlaid by an artificial turf, thereby mimicking a golfing surface.

6. A floor system as in claim 1, wherein the vertically-adjustable devices comprise remotely operable jacks.

7. A floor system as in claim 6, wherein said vertically-adjustable devices include servo motors driving said jacks.

8. A floor system as in claim 7, wherein said central individual control of said vertically-adjustable devices is controlled by a computer, and wherein the computer accesses data corresponding to a number of selectable pre-configured contours, such that selection of one of the pre-configured contours causes the height of the devices to vary so as to move the floor surface to a configuration corresponding to the selected pre-configured contour.

9. A floor system as in claim 7, wherein said floor surface is overlaid by an artificial turf, thereby mimicking a golfing surface.

10. A floor system as in claim 6, wherein said central individual control of said vertically-adjustable devices is controlled by a computer, and wherein the computer accesses data corresponding to a number of selectable pre-configured contours, such that selection of one of the pre-configured contours causes the height of the devices to vary so as to move the floor surface to a configuration corresponding to the selected pre-configured contour.

11. A floor system as in claim 10, wherein said floor surface is overlaid by an artificial turf, thereby mimicking a golfing surface, and wherein said data accessed by said computer is elevation data of various real golf greens.

12. A floor system as in claim 6, wherein said floor surface is overlaid by an artificial turf, thereby mimicking a golfing surface.

13. A floor system as in claim 1, wherein the vertically-adjustable devices comprise at least one CNC slide mechanism arranged to produce vertical motion.

14. A floor system as in claim 1, wherein said central individual control of said vertically-adjustable devices is controlled by a computer, and wherein the computer accesses data corresponding to a number of selectable pre-configured contours, such that selection of one of the pre-configured contours causes the height of the devices to vary so as to move the floor surface to a configuration corresponding to the selected pre-configured contour.

15. A floor system as in claim 14, wherein said floor surface is overlaid by an artificial turf, thereby mimicking a golfing surface, and wherein said data accessed by said computer is elevation data of various real golf greens.

16. A floor system as in claim 1, wherein said floor surface is overlaid by an artificial turf, thereby mimicking a golfing surface.

* * * * *